US005400925A

United States Patent [19]

Simmen

[11] Patent Number: 5,400,925

[45] Date of Patent: Mar. 28, 1995

[54] DISPENSING DEVICE ADAPTED FOR DISPENSING MORE THAN ONE MATERIAL FROM A CARTRIDGE

[75] Inventor: Christian Simmen, Mahwah, N.J.

[73] Assignee: Coltene/Whaledent, Inc., Mahwah, N.J.

[21] Appl. No.: 164,140

[22] Filed: Dec. 9, 1993

[51] Int. Cl.[6] ..... B67D 5/52

[52] U.S. Cl. ..... 222/137; 222/145; 222/326; 222/340; 222/391

[58] Field of Search ..... 222/135, 137, 145, 326, 222/340, 391

[56] References Cited

U.S. PATENT DOCUMENTS

| | | | |
|---|---|---|---|
| 2,233,587 | 3/1941 | Crewe | 222/391 X |
| 4,009,804 | 3/1977 | Costa et al. | 222/391 |
| 4,681,524 | 7/1987 | Ikeda et al. | 222/326 X |
| 4,826,053 | 5/1989 | Keller | 222/340 |
| 4,834,268 | 5/1989 | Keller | 222/327 |
| 4,911,328 | 3/1990 | Keller | 220/47 |
| 5,123,568 | 6/1992 | Keller | 222/49 |
| 5,137,181 | 8/1992 | Keller | 222/134 |
| 5,192,008 | 3/1993 | Hwan | 222/326 X |
| 5,203,476 | 4/1993 | Keller | 222/145 X |
| 5,263,614 | 11/1993 | Jacobsen et al. | 222/137 |

*Primary Examiner*—Andres Kashnikow
*Assistant Examiner*—Joseph A. Kaufman
*Attorney, Agent, or Firm*—Helfgott & Karas

[57] ABSTRACT

A device for dispensing a predetermined amount of fluid material from chambers within a cartridge. This device includes a housing, a trigger pivotably connected to the housing and a plunger having teeth on a top side thereof entering the housing and passing through an upper part of the trigger. A ratchet is attached to the upper part of the trigger and engaged between the plunger teeth. When force is applied to the trigger, the ratchet is pushed forward, causing the plunger to also move forward, dispensing the contents of each of the chambers within the cartridge. When the trigger is released, the ratchet moves backward causing the plunger to move with the ratchet. The plunger moves backward a short distance until the force applied by the ratchet is overcome through frictional engagement between the plunger and a frictional brake mounted on the housing, at that point the ratchet slides over the next tooth behind it on top of the plunger.

23 Claims, 11 Drawing Sheets

DISPENSING DEVICE ADAPTED FOR DISPENSING MORE THAN ONE MATERIAL FROM A CARTRIDGE

BACKGROUND OF THE INVENTION

1. Field of the Invention

The present invention relates generally to dispensers and, more particularly, to dispensers able to dispense more than one material from a divided cartridge.

2. Description of the Prior Art

Dispensers have been generally used for extruding material from a cartridge. The cartridge, in the present case, includes at least two chambers, each chamber containing a different type of material. The dispenser dispenses a predetermined amount of each material from the chambers and delivers the material to a static mixer. The materials will then be mixed together in the static mixer.

In general, dispensers are typically in the form of a pistol including a handle, a trigger and a body portion. A cartridge is loaded in the body portion of the dispenser and the trigger is pulled. The trigger exerts a force on a ratchet which is engaged with a plunger. The force exerted on the ratchet is in a direction towards the cartridge. The ratchet, due to its engagement with the plunger, exerts a force on the plunger which extends into the cartridge. This pushes the plunger deeper into the cartridge forcing material within the cartridge chambers out of the cartridge through outlets at a dispensing end of the cartridge. The material enters a static mixer connected at the dispensing end where it is then mixed and dispensed for use.

When the desired amount of material is dispensed, the material remaining needs to settle within the cartridge. Afterflow of the material is a problem encountered when the material is settling. This occurs when, upon settling, material exits the cartridge through the dispensing end. When this occurs, the material within the different chambers of the cartridge collects at the outside of the dispensing end of the cartridge. This may result in the materials mixing and hardening at the discharge end of the cartridge. The hardening of the material in this manner may restrict further use of the cartridge.

An example of a typical dispenser is shown in U.S. Pat. No. 4,826,053. This patent discloses separate components for activating the plunger and for pulling it back a short distance after activation. For activation, the trigger is pulled, releasing a ratchet arm from its position between two sawteeth on the ram. The ram is driven forward a distance and the ratchet arm comes to rest between the next two sawteeth behind its previous position. To provide the backward motion, when the ram is moved forward, it coils a spring attached between a stationary support part and a retrieval element attached around the ram. Once the forward motion ceases, the spring recoils moving the ram back a short distance.

U.S. Pat. No. 4,911,328 discloses another prior art dispenser which guides a pair of pistons evenly through the chambers of a cartridge while eliminating tilting of the pistons due to unequal forces. These unequal forces are a result of possibly different viscosities of the material within the chambers and/or different cross sections of the chambers. The pistons are engaged by a plunger when inserted into a dispenser.

U.S. Pat. No. 4,834,268 discloses another prior art dispenser having a piston with an annular sealing means and rigid head with a first grooved portion in the piston head and a second grooved portion in the piston wall. When thrust is applied to the piston, the grooved portions deform, squeezing the sealing means from the grooves and thereafter releasing the sealing means upon stopping the thrust allowing the piston to move in the opposite direction.

While some of the prior art dispensers have been designed to prevent the afterflow of the material, they have not proven to be very effective. Also these prior art devices have not had other safety features needed for a dispenser.

It is therefore desired to have a dispenser which does not allow dispensing of material when the cartridge is not secured in place, which provides a backward motion of the plunger to prevent afterflow of the material, and a device which would also prevent sliding of the plunger when the plunger is not under control of the ratchet.

SUMMARY OF THE INVENTION

It is, accordingly, an object of the present invention to provide a dispenser which dispenses an equal predetermined amount of material concurrently from more than one chamber in a divided cartridge.

It is another object of the present invention to provide a dispenser which includes a safety mechanism to prevent activation of the plunger when a tab is lifted.

A further object of the present invention is to provide a dispenser in which the plunger moves in a forward direction to dispense material from the cartridge and thereafter in a slight backward direction to allow space for settling of the material remaining in the cartridge thereby preventing afterflow of material out of the cartridge.

A still further object of the present invention is to provide a dispenser wherein the plunger is prevented from sliding when it is not under control by the ratchet.

With respect to the dispenser of the present invention, there is provided a plunger, which is in frictional engagement with the housing of the dispenser, and having a toothed upper side. A ratchet arm, which is positioned in contact with and rests on the inclined surface of the teeth is actuated by a trigger. A retention spring exerts a pressure on the ratchet arm and is loaded to hold the ratchet arm against the teeth in a frictionally slideable manner. When the trigger is squeezed it pushes the ratchet arm against the engagement wall of the tooth in front of it, thus pushing the plunger forward against pistons positioned in the chambers of a cartridge, supported in the housing, to thereby dispense material from the cartridge. The plunger continues forward until the trigger is restricted from further movement by a back wall of the grip portion. As the trigger is then released, it permits the ratchet arm to retract. However, the loaded retention spring holds the ratchet arm in engagement with the plunger, pulling the plunger slightly backwards along with the ratchet arm. This occurs until the frictional force between the housing and the plunger halts the backward movement of the plunger through the housing by overcoming the combination of the force of the retention spring and the retraction force applied by the trigger. The ratchet arm is then free to ride over the teeth.

The piston is thus moved back to a position slightly spaced from the material in the chamber. This space allows the material in the chamber to flow backwards and thus eliminates the problems associated with after-flow from the dispensing end of the cartridge.

The aforementioned objects, features and advantages of the invention will, in part, become obvious from the following more detailed description of the invention which, when taken in conjunction with the accompanying drawings, form an integral part thereof.

DETAILED DESCRIPTION OF THE PREFERRED EMBODIMENT

Figure 1:
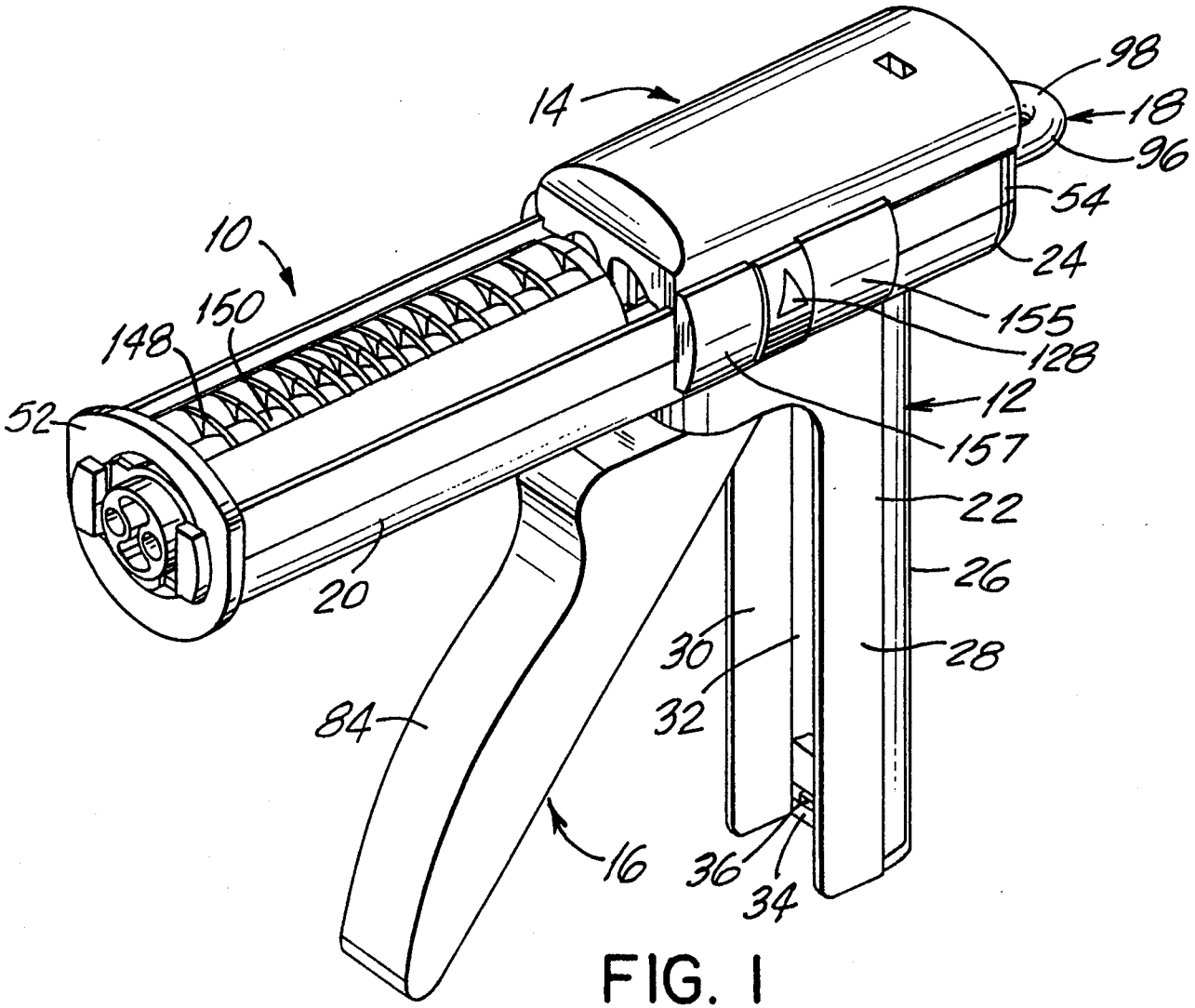
FIG. 1 is a side perspective view of the dispenser of the present invention.
Figure 2:
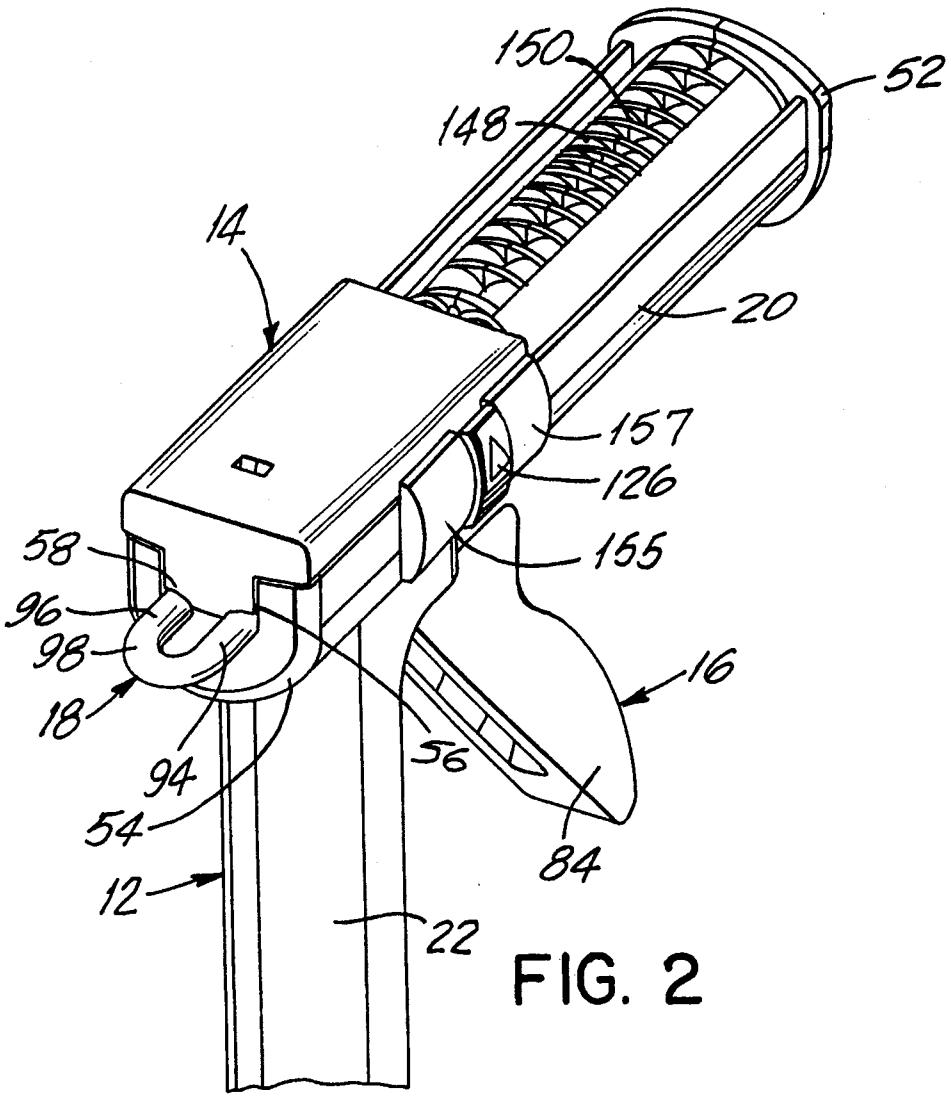
FIG. 2 is a rear perspective view of the dispenser of the present invention.

Referring now to FIGS. 1–4, there is shown a dispenser indicated generally by the number 10. The dispenser 10 is comprised a housing 12, a hood 14, a trigger 16 and a plunger 18. The housing 12 is pistol shaped including a horizontal body portion 20 and a grip portion 22 connected to each other such that an end of the grip portion 22 meets a base 42 of the body portion 20 slightly removed from a back end 24 thereof. The body portion 20 has a general shape which conforms with the outside surface of a cartridge 148. The cartridge 148 will be loaded, for use, into the body portion 20 of the housing 12. For further details of the cartridge, reference is made to co-pending U.S. patent application Ser. No. 07/997,679 assigned to the same assignee of the present invention.

Figure 3:
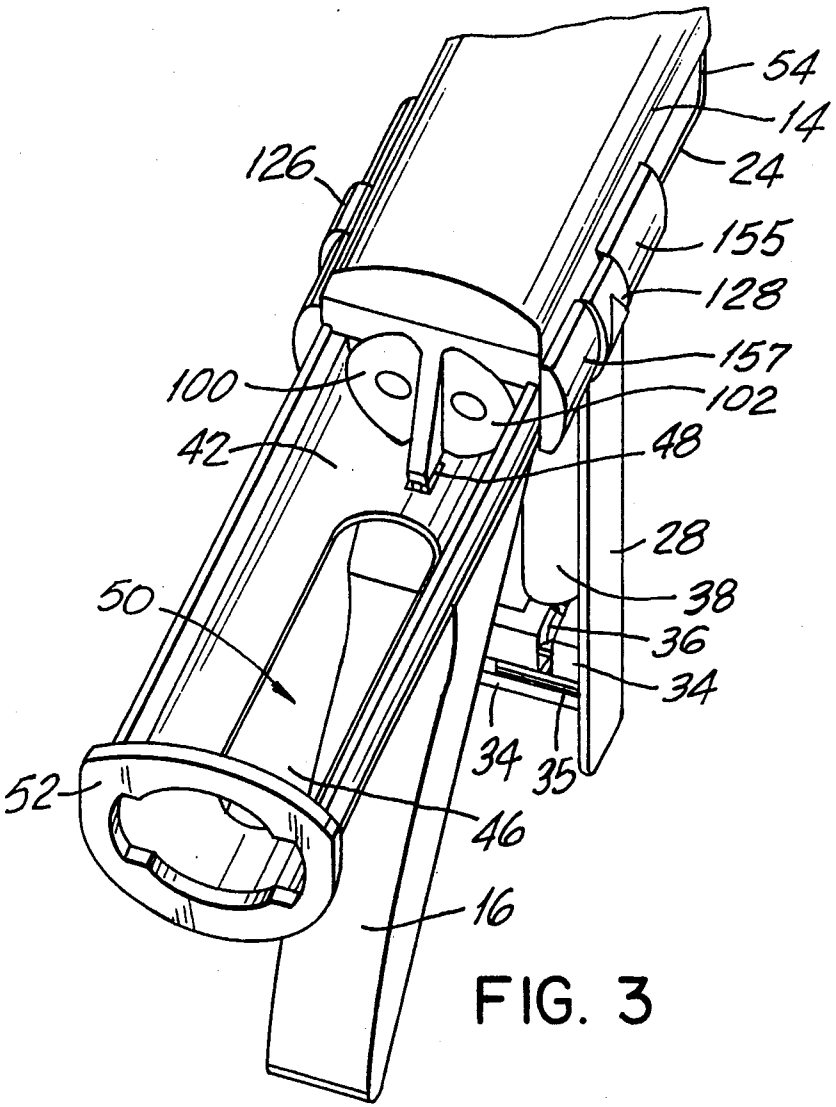
FIG. 3 is a side perspective view of the dispenser of the present invention without a cartridge loaded inside.
Figure 5:
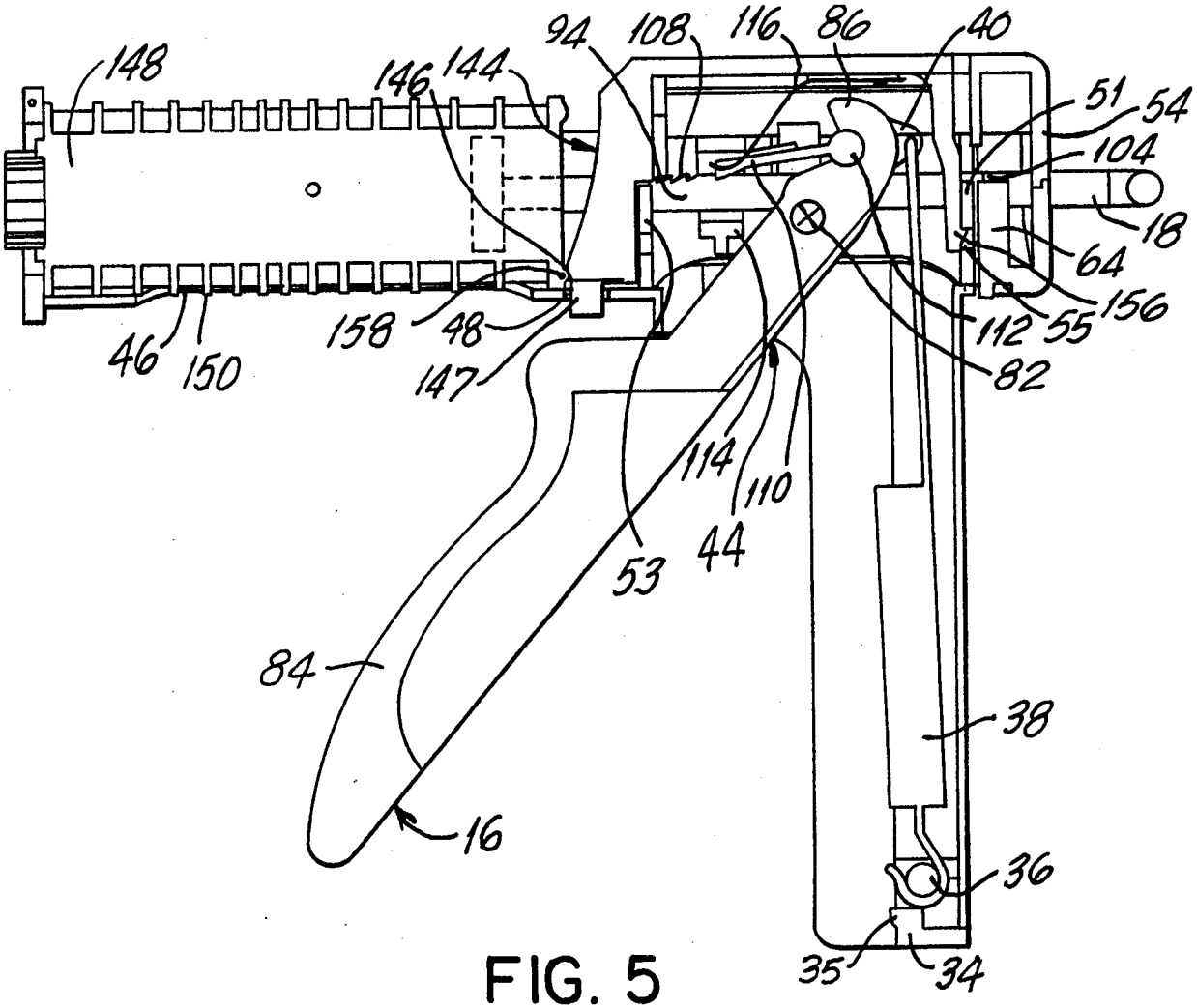
FIG. 5 is a view taken along the line 5—5 of FIG. 4.

The grip portion 22 has a back wall 26 and left and right opposing side walls 28 and 30. The back wall 26 is arcuate in shape. The back, left and right walls 26, 28 and 30 respectively define a channel 32 extending the length of the grip portion 22. At the base of the grip portion 22 within the channel 32 is a plug 34. Housed within the plug 34 is a pin 36. The plug 34 and the pin 36 form one single part. The plug 34 is anchored to the housing 12 through a recess within the grip portion 22. Attached to the pin 36 is the lower end of a return spring 38, as is shown in FIG. 3, which spring then extends upward through the channel 32. The return spring 38 is connected at its upper end to the top end of the trigger 16 at a connection point 40, as seen in FIG. 5.

Figure 9:
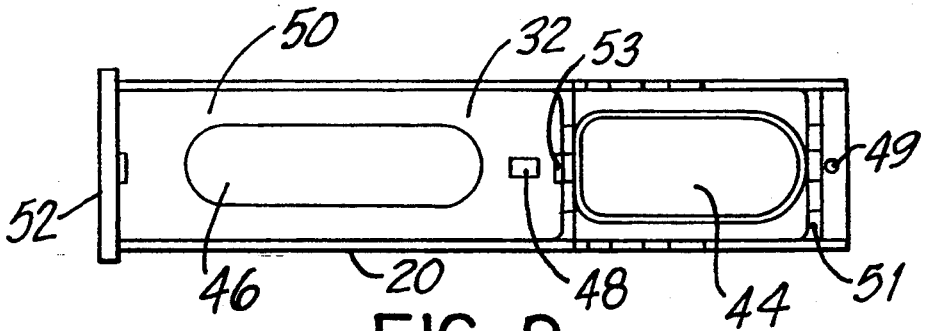
FIG. 9 is a top view of the housing.

The base 42, of the body portion 20 has three openings, as is shown in FIG. 9. A first opening 44 begins at the back end 24 of the body portion 20 and extends a short distance along its length. This opening 44 is of a width approximately equal to that of the channel 32. The trigger 16 extends into this opening 44 and can pivot therethrough. As shown in FIG. 9, a compartment 50 is formed in the body portion 20 from the distal end and extending to a middle divider 53. Referring again to FIG. 9, second opening 46 is found in the base of the compartment 50. The compartment 50 is for receiving a cartridge 148 containing the material to be dispensed. Mating ribs 150 provided on the lower side of cartridge 148 align with the opening 46. The third opening 48 is small and square shaped. This opening 48 is positioned between the first and second openings 44, 46 and provides a catch for the hood 14 to lock onto.

Attached to the dispensing end of the body portion 20 is a face plate 52. The face plate 52 has a hole for receiving the dispensing end of a cartridge 148. When a cartridge 148 is placed in the compartment 50, the dispensing end extends through the hole in the face plate 52 for added stability. At the back end of the body portion 20 is an end divider 51 and at a midsection is a divider 53 as best seen in FIG. 9. These dividers each have a pair of "U" shaped grooves which acts as support for the plunger 18. The end divider 51 includes a recess 55 for attachment with the hood 14. The middle divider 53 acts as an end wall for the compartment 50.

Figure 7:
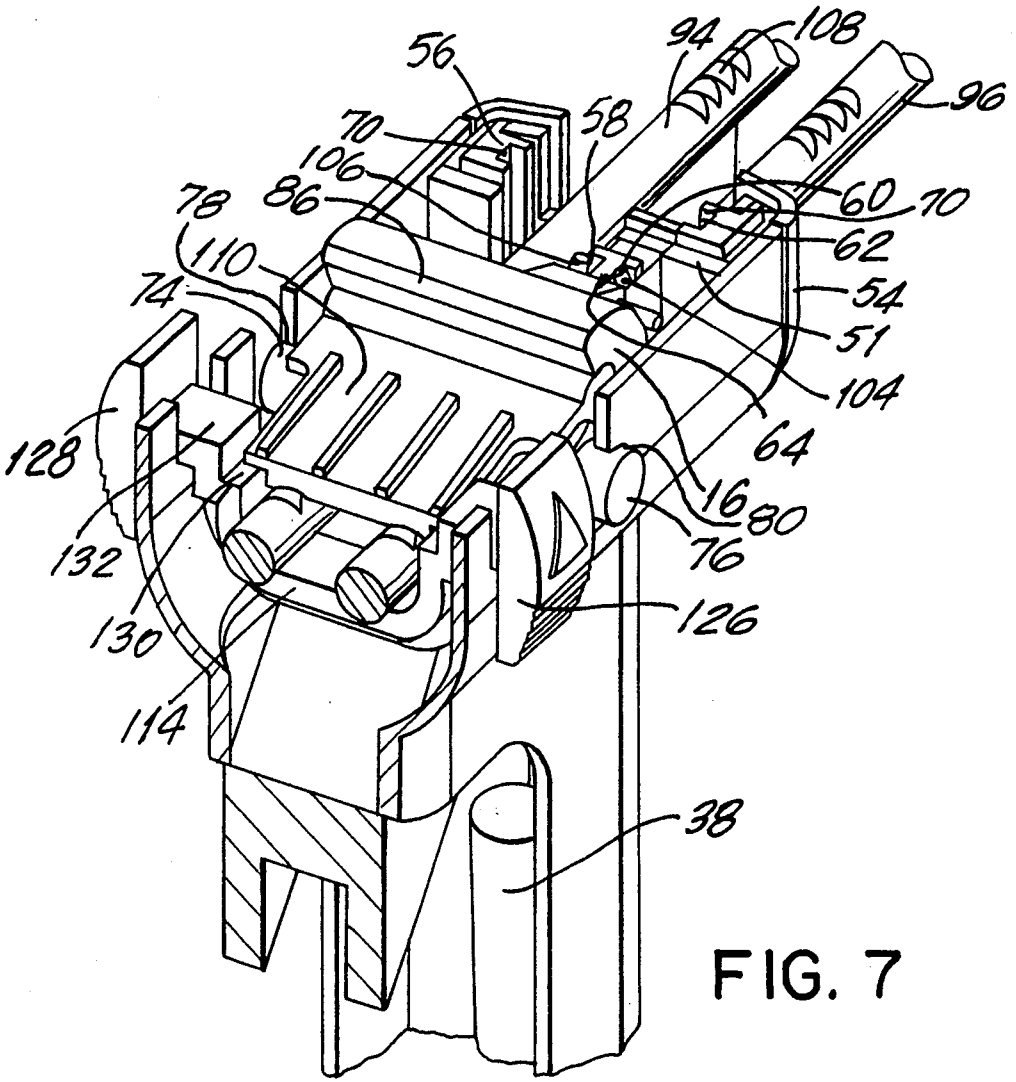
FIG. 7 is an enlarged broken away perspective view of the components located below the hood of the present invention.

Attached to the body portion 20 through hole 49 is an end cap 54. As best seen in FIG. 7, forward of end cap 54 is the clutch assembly including two adjacent "U" shaped slots lying in a common plane and each receiving a respective leg of the plunger. As seen in FIG. 7, the U shaped slot on the left has opposing sides 56, 58 and the U slot shaped on the right has opposing sides 60, 62. The median sides 58, 60 are on opposite faces of a median divider 64. Each side 56, 58, 60, 62 is found with a U-shaped 70 groove formed into the respective side.

Figure 8:
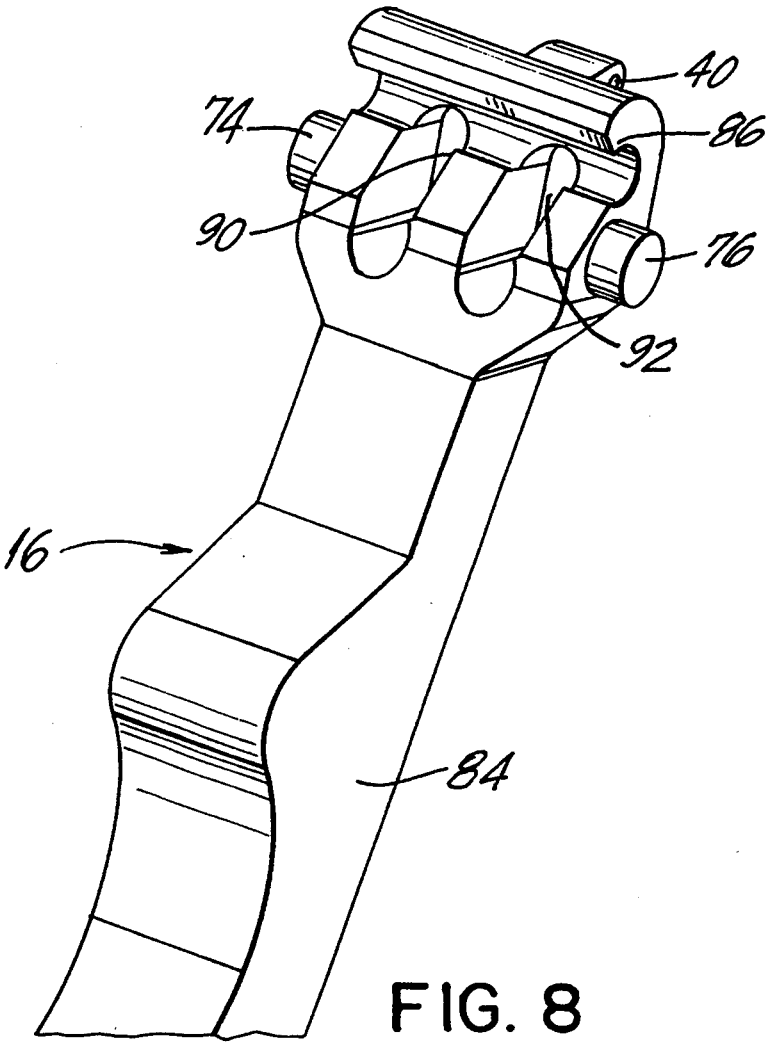
FIG. 8 is a perspective view of the trigger of the present invention.

The upper end of the trigger 16 can be seen in FIG. 8. The trigger 16 extends through the first opening 44 in the body portion 20 of the housing 12 as shown in FIG. 9. The trigger 16 is of a width approximately equal to the width of the first opening 44. The trigger 16 is secured within the housing 12 by pivot pins 74, 76, as can be seen in FIGS. 7 and 8. The pivot pins 74, 76 extend outward from opposite sides of the trigger 16 at a point slightly below the top end of the trigger 16. The pivot pins 74, 76 extend through respective recesses 78, 80 within the housing 12 and are rotatable about a pivot point 82 identified by the letter "x" shown in FIG. 5. The trigger 16 is thus able to rotate a predefined amount about the pivot point 82 when force is applied to the handle 84 of the trigger 16. The trigger 16 can rotate until halted by the stopper 35, as shown in FIGS. 3 and 5, of the grip portion 22. The top end of the trigger 16 includes a hook 86. The hook 86 extends above the pivot pins 74, 76 and faces towards the body portion 20 of the housing 12 wherein the cartridge 148 is secured. Attached to the back side of the hook 86 at the connection point 40 is the return spring 38, as shown in FIG. 5. Holes 90, 92 extend through the trigger 16 at a position aligned with the "U"-shaped slots in the clutch assembly. The handle 84 depends below the body portion 20 of the housing 12 and is of a shape which can be easily grasped when applying force to dispense the material within the cartridge 148 on one side and includes a groove (not shown) on an opposite side to fit within the channel 32 and around the return spring 38 when depressed.

Extending into the housing 12 through the "U"-shaped slots in the clutch assembly is the plunger 18. The plunger 18 lies in a horizontal plane and is U-shaped, having a pair of identical legs 94, 96 connected to each other at a bight portion 98. The legs 94, 96 of the plunger 18 extend through respective slots 56, 58 and 60, 62 in the clutch assembly and continue through respective holes 90, 92 in the trigger 16 and into the compartment 50 of the body portion 20. At the free end of each leg 94, 96 is a plunger plate 100, 102 as shown in FIG. 3. The plunger plates 100, 102 are semi-circular in shape, however, the corners which would typically have a sharp edge have been rounded. The shape of the plunger plates 100, 102 match the shape of the chamber entrances in the cartridge 148, as is described in the aforementioned co-pending U.S. application Ser. No. 07/997,679. When the plunger 18 is engaged, the plunger plates 100, 102 are moved forward into the cartridge 148 to engage pistons within each chamber. The plunger plates 100, 102, as they move forward, force the pistons forward in the cartridge chambers, to dispense material from the cartridge 148.

With reference to FIG. 7, the clutch assembly further includes a brakewire 104 extending around leg 96 of the plunger and positioned within the U-shaped grooves 70 formed within the sides 60, 62 of the rightmost U-shaped slot. A similar brake wire 106 extends around leg 94 of the plugs and positioned within the U-shaped grooves of the leftmost U-shaped slot having sides 56,58. The diameter of the brake wires 104, 106, have a diameter smaller than that of the grooves in which they are placed. This allows for sliding of the respective brake wires 104, 106 within its respective grooves 70. Each of the brake wires 104, 106 are in frictional contact with their respective legs 94, 96.

Figure 4:
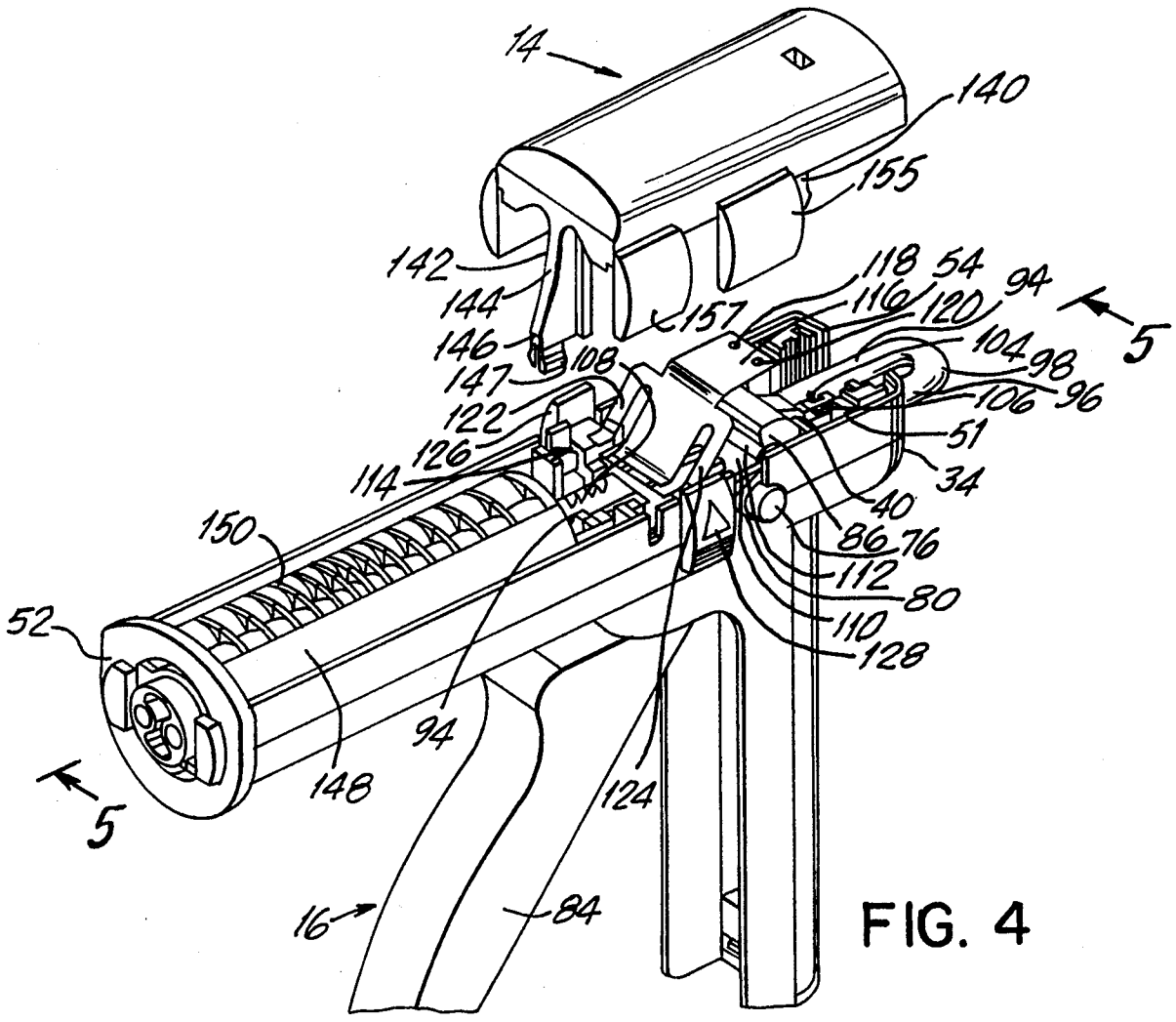
FIG. 4 is a perspective view of the dispenser of the present invention with the hood raised.

On an upper side of each leg 94, 96 of the plunger 18 are sawteeth 108, as shown in FIG. 5. Engaged within the curved portion of the hook 86 of FIG. 8, and forming a ball and socket type joint is a ratchet 110, as shown in FIG. 5. The ratchet 110 has the shape of a substantially rectangular plate. At its distal end, the ratchet 110 is able to engage the sawteeth 108 on both plunger legs 94, 96, as can be seen in FIG. 7. At its opposing end, the ratchet 110 has a ball type joint 112 to engage with the hook 86 of the trigger 16. The hook 86 is arcuate so as to surround more than fifty percent of the diameter of the ball joint 112. As shown in FIG. 4, a lifter mechanism 114 is positioned inside the body portion 20 of the housing 12 and is able to lift the ratchet 110 from engagement between the sawteeth 108. On top of the ratchet 110, and exerting a downward pressure onto the lifter mechanism 114, is a leaf spring 116. Leaf spring 116 causes the ratchet to apply dragging pressure onto the plunger 18 for dragging the plunger 18 slightly backward. The leaf spring 116 has two holes 118, 120, extending through and spaced along a back portion thereof for coupling with the hood 14 by means of bosses melted to a mushroom head 152, 154. The leaf spring also includes a pair of side arms 122, 124 each extending from a respective side of the leaf spring body.

The lifter mechanism 114, as can be seen in FIG. 7, extends across the body portion 20 beneath the plunger 18 and includes two manipulating tabs 126, 128 each seated in a cavity on opposite sides of the body portion 20. The manipulating tabs 126, 128 extend outside the housing 12. The lifter mechanism 114 extends a distance below the plunger legs 94, 96 and continues upwardly on either side of the plunger legs 94, 96, providing two pairs of ledges, an inner pair 130 and an outer pair 132. The ratchet 110 rests on the inner pair of ledges 130 and each side leg 122, 124 of the leaf spring 114 rests on a respective one of the outer pair of ledges 132.

Figure 6:
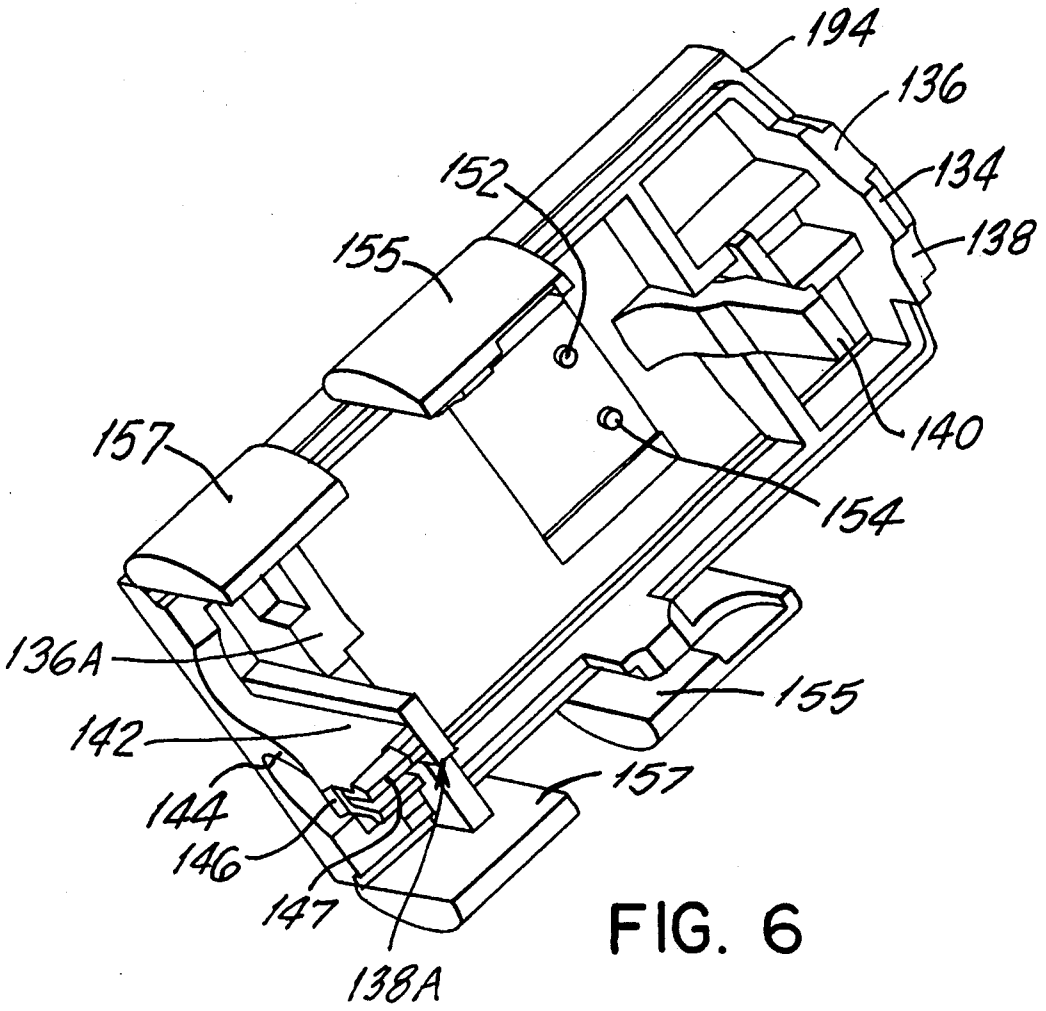
FIG. 6 is a perspective view of the under side of the raised hood of the present invention.

Placed over a rear part of the body portion 20 is a hood 14. A ledge 134 depends from the underside of the hood 14 at a back end thereof, as can be seen in FIG. 6. The ledge 134 is shaped to mate with the end cap 34. Spaced on either side of the ledge 134 are arcuate sides 136, 138 and 136A, 138A, as shown in FIG. 6, to clamp over the plunger legs 94, 96. Spaced forward of the ledge 134 is a first locking tab 140 which depends from the underside of the hood 14. A second locking tab 142 depends from the underside thereof a sufficient distance to extend beneath compartment 50 when in a closed position, as can be seen in FIG. 4. Locking tab 142 has a front side which is arcuate 144, having an arc facing away from the hood 14. At the base of this arcuate side 144 is a lip 146. Depending from the underside of the lip 146 is a bifurcated clamp 147. Also depending from the underside of the hood 14, positioned to engage the recesses 118, 120 in the leaf spring 116, are the bosses 152, 154. The hood also includes two pairs of spaced apart side flaps 155, 157. The first pair of flaps 155 depend from the hood 14 and, when the hood 14 is positioned on the housing 12, are adjacent a respective manipulating tab 126, 128 on the lifter mechanism 14 and cover a respective pivot pin 74, 76 extending from the trigger 16 through the housing 12. The second pair of flaps 157 depend from the hood 14 and, when the hood 14 is positioned on the housing 12, are on the opposing side of a respective manipulating tab 126, 128 and act as a guide for the lifter mechanism 14, limiting the motion of the lifter along a single plane.

When the hold 14 is placed in position over the housing 12, each of the arcuate sides 136, 138 on the sides of the ledge 134 meet with the top side of the respective plunger legs 94, 96, the first locking tab 140 has a lip at its distal end which engages with a recess 55 found in divider 51. The bifurcated clamp 147 of the forward locking tab 142 engages with the third opening 48 in the body portion 20 to hold the hood 14 in place. The front arcuate side 144 of the second locking tab 142 aids in loading a cartridge 148 into the dispenser. The lip 146 mates with a notch 158 extending from the cartridge 148 to aid in holding the cartridge 148 securely within the dispenser. The plugs 152, 154, engage the recesses 118, 120 in the leaf spring 116.

In operation, the hood 14 is locked in place by engaging the first locking tab 140 attached to the hood 14 within a recess in divider 55 as can be seen in FIG. 5. The second locking tab 142 extends through the body portion 20 and the clamp 147, at its base, engages the third opening 48 in the housing 12. The bosses 152, 154 are positioned within the recesses 118, 120 in the leaf spring 116. The leaf spring 116 is thus attached to the hood 14 and held in its position by the plugs 152, 154 so that it may exert its downward bias force on the ratchet 110.

At this point, a cartridge 148 is loaded in the compartment 50. The arcuate side 144 of the second locking tab 142 allows the cartridge 148 to easily slide into place. The cartridge 148 is placed in the compartment 50, at an angle, with the dispensing end facing into the compartment 50. The dispensing end is positioned within the hole in the face plate 52 and the opposite end of the cartridge 148 is slid along the arcuate side 144 of the second locking tab 142 so that the notch 158 is engaged with the protruding lip 146. The cartridge 148 has two internal chambers alongside each other. Each chamber contains a different type of material. On the upper and lower exterior of the cartridge 148 are mating grooves 150. The mating grooves 150 extend through and are spaced to form a pressure fit with the sides of the second opening 46 in the body portion 20.

When the manipulating tabs 126, 128 on the lifter mechanism 114 are raised, the ratchet 110 is lifted from the sawteeth in the plunger and prevented from operation by the trigger 16. The manipulating tabs 126, 128 are lifted manually by the user of the dispenser. The lifting of the tabs 126, 128 raise both the ratchet 110 and the leaf spring 116 which are seated on respective pairs of ledges 122, 124 on the lifter mechanism 114. The ratchet 110 is lifted from its position of engagement between the sawteeth 108. The lifting of the ratchet 110 prevents the forward motion of the ratchet 110 and thus releases plunger 18. This prevents operation by the trigger 16. It also permits a free pull back of the plunger 18 to initialize the dispenser permitting removal of an old cartridge 148 and insertion of a new cartridge 148.

When the lifter mechanism 114 is released it returns to its original position, whereby the leaf spring 116 depresses the ratchet 110 so that it re-engages the sawteeth 108. The device is now ready to dispense the contents in the cartridge 148.

The user holds the grip portion 22 of the housing 12 and pulls back on the handle 84 of the trigger 16. This will cause the top end of the trigger 16 to pivot forward as the force applied to the handle 84 overcomes that of the return spring 38, causing the spring 38 to stretch. The pulling back on the handle 84 will also cause the hook 86 at the top end of the trigger 18 to pivot forward against the ratchet 110.

Since the ratchet 110 is engaged with the sawteeth 108 on the plunger 18, the forward movement of the ratchet 110 causes the plunger 18 to move forward a distance equal to that moved by the ratchet 110. The leaf spring 116 exerts a depressing force on the ratchet 110 serving to keep it in a pressure engagement with the sawteeth 108. The forward movement of the plunger 18 causes the brake wires 104, 106 which are in frictional contact around the plunger legs 94, 96 to slide across their respective grooves 70 to the forward end of their respective groove. Once the brake wires 104, 106 slide across their respective grooves, they meet the opposite wall of the respective groove at which time, the brake wires 104, 106 cannot slide any further within their groove. Movement of the brake wires 104, 106 ceases, but the plunger 18 continues to move forward until the ratchet 110 stops. The plunger 18 continues this forward movement since the force applied on the plunger 18 by the trigger 16, through the ratchet 110, overcomes the frictional force between the plunger 18 and the brake wires 104, 106.

The forward motion of the plunger legs 94, 96 directs the plunger plates 100, 102 into respective chambers in the cartridge 148. The plunger plates 100, 102 engage pistons within the chambers directing the pistons in a forward direction and thus forcing the material within the chambers out through respective outlets at an opposite end of the cartridge 148. The forward motion stops when the trigger meets the back wall 26 of the grip portion 22 and can not move any further.

The forward motion of the ratchet 110 is a measured amount based upon the distance travelled by the trigger 16 from its initial rest position until it meets the back wall 26 of the grip portion 22, so that a correct amount of material may be forced out of the chambers with each trigger depression. Once the ratchet 110 has stopped, the trigger 16 is reset. This is accomplished through release of the handle 84 permitting the return spring 38, through the recoiling, to pivot the trigger 16 in the rearward direction. The force which had been exerted on the trigger 16 caused the return spring 38 to stretch. Once the pressure on the handle 84 is released the return spring 38 will recoil thus resetting the trigger 16.

The recoiling of the return spring 38 also causes the ratchet 110 to move backward. This occurs because of the ball and socket type joint connection between the trigger 16 and ratchet 110. The ratchet 110 is engaged within the hook 86 of the trigger 16 and thus moves with the trigger 16. Under pressure of the leaf spring 116 the ratchet 110 is prevented from immediately sliding up and along the incline of the sawtooth 108. Thus, as the ratchet 110 is pulled backward, it drags the plunger 18 with it. As the plunger 18 moves back, the frictional brake wires 104, 106 around the plunger legs 94, 96 slide freely backward within their respective grooves until the brake wires 104, 106 reach the rear walls of their respective grooves which thus stop the further free movement of the brake wires 104, 106. The backward motion of the plunger 18 will continue until the brake wires 104, 106 slide back across the respective grooves. At this point, frictional contact between the brake wires 104, 106 and the respective plunger legs 94, 96 is such that it overcomes the downward engagement force which the leaf spring 116 applies onto the ratchet 110, and the force of the return spring 38. When moving backward the force on the ratchet 110 is that of the leaf spring 116 and the return spring 38. When moving forward, however, there is a much greater force applied by the force that the trigger 16 exerts. The forward force of the trigger 16 is great enough to overcome the frictional force between the brake wires 104, 106 and the plunger legs 94, 96 so that in the forward direction the plunger 18 moves further than the sliding movement of the brake wires 104, 106. However, in the backward direction, the limited force will not overcome the frictional force between the plunger legs 94, 96 and the brake wires 104, 106. The plunger 18 will thus only move backward a distance equal to that travelled by the brake wires 104, 106 across their respective groove.

When the backward motion of the plunger 18 ceases, the continuing motion of the ratchet 110 causes it to slide over the sawteeth 108 on each of the plunger legs 94, 96. Since there is no space between the sawteeth 108 on the plunger legs 94, 96, the ratchet 110 will come to rest in its new position between the next pair of adjacent sawteeth 108 on the plunger 18. Thus, no excess motion of the plunger 18 is possible.

The dispenser is thus reset and the plunger plates 100, 102, at the free ends of the plunger legs 94, 96 are rearwardly displaced a slight distance behind the material within the chambers allowing the material to settle in the backward direction. This helps prevent an afterflow of the material through the outlets at the exit of the chambers.

The dispenser is operated in the same manner until the cartridge 148 is empty. At that time, the tabs 126, 128 of the lifter mechanism 114 are raised to allow the plunger legs 94, 96 to be rearwardly slid from the chambers of the old cartridge 148 and the used cartridge 148 to be removed. The old cartridge 148 is then replaced with a new one. The material within the chambers of the new cartridge 148 is then dispensed in the same manner.

Figure 10:
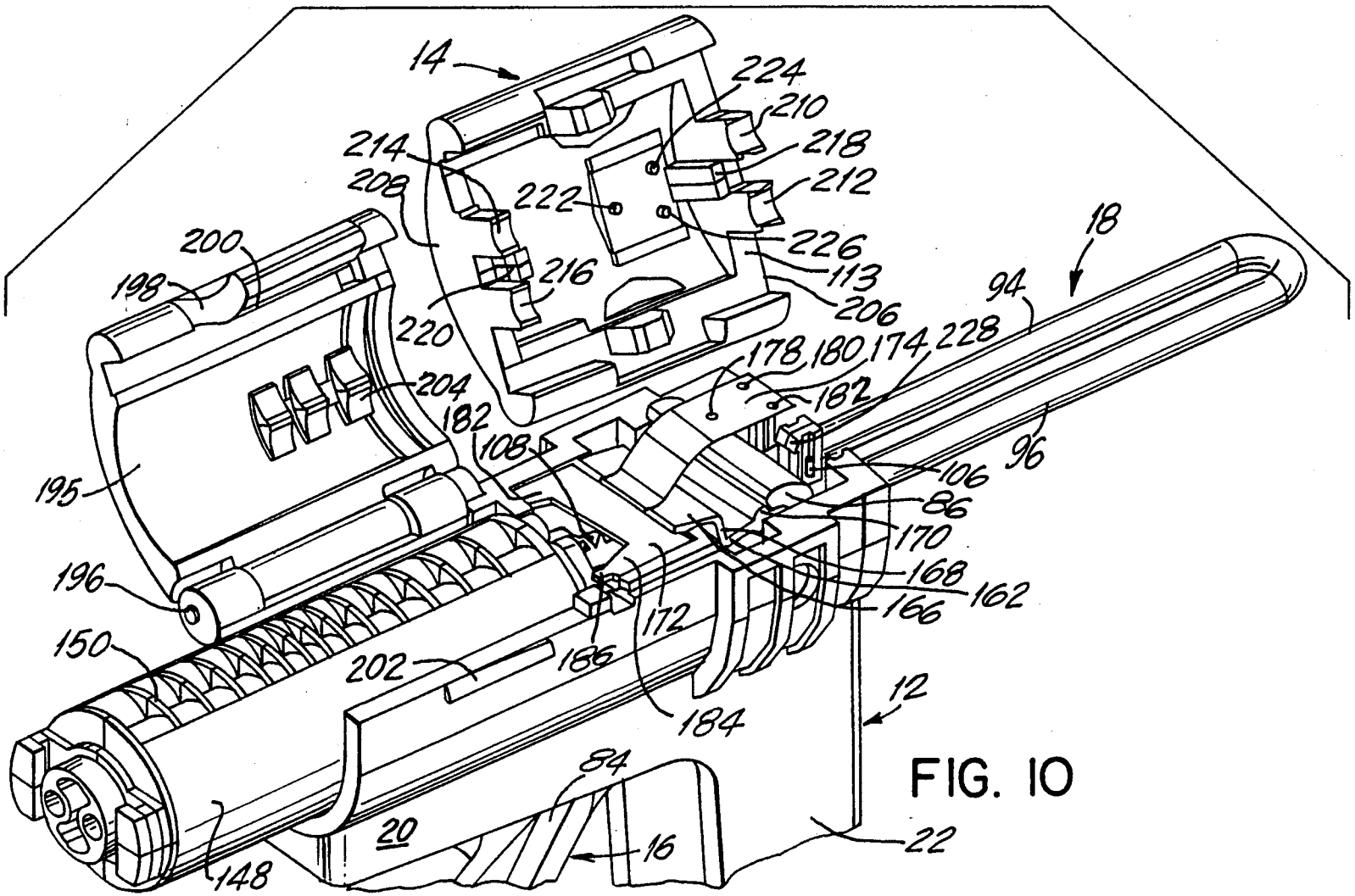
FIG. 10 is a perspective view of another embodiment of the present invention with the hood and cover raised.
Figure 11:
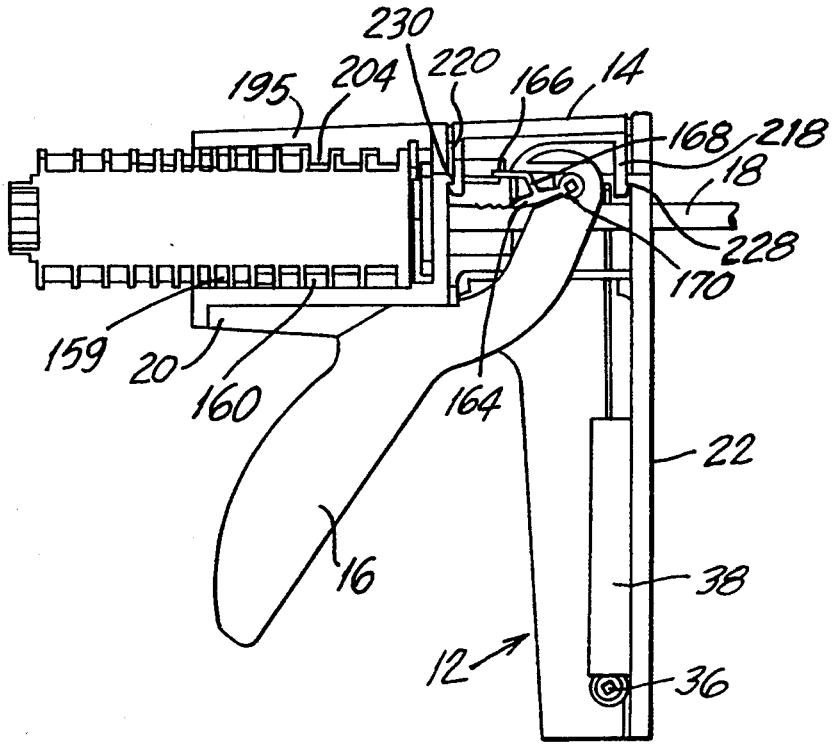
FIG. 11 is a cut away view showing the internal components of the other embodiment of the present invention.
Figure 12:
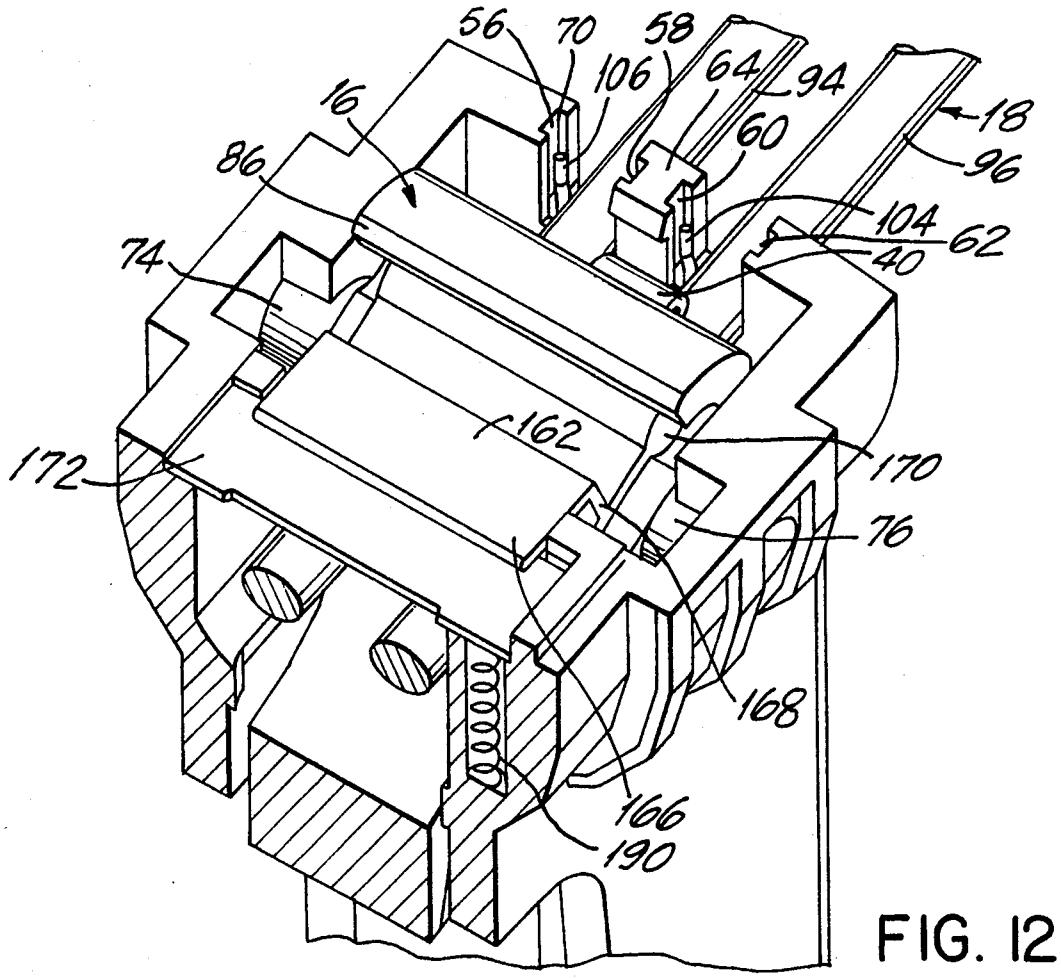
FIG. 12 is an enlarged broken away perspective view of the components of the other embodiment of the dispenser of the present invention.

The dispenser of the present invention may take on an alternate embodiment as shown in FIGS. 10–12. This embodiment will be described with reference to differences with the previously described embodiment. Like components are labelled similarly. In this embodiment the body portion 20 and the grip portion 22 are connected at medial ends to each other. Furthermore, the pair of "U" shaped slots 60, 62 are positioned at an upper end of the back wall 24 having a slotted divider 64 formed therebetween and opposing grooves 70 are on each exterior sides 56, 58 facing into the respective "U" shaped slots. The "U" shaped slots also have similar grooves on opposing sides of the slots 60, 62 opposite the slots 66, 68 of the divider. These slots are for placement of the brake wires 104, 106.

Within and along the inside base of the compartment 159 are a number of spaced tabs 160 which are to be received in the mating grooves 150 provided in the cartridge 148. These tabs 160 act to retain the cartridge 148 in position within the dispenser.

A cover 195 is rotably engaged at the top of the body portion 22 adjacent the hood 14 by a pivot pin 196. The cover 195 is also rounded on its top side and has a release handle 198 with a notch 200 on a side opposite the pin 196 connection. The notch 200 is for engagement with a recess 202 on the side of the body portion 22 opposite to the pin 196. Extending outward from the underside of the cover 195 are a number of spaced locking tabs 204 for mating with the spaced grooves 150 on the top side of the cartridge 148. The cover 194 covers the compartment 50 formed in the body portion 22.

The ratchet 162 of this embodiment has two legs; a lower leg 164 and an upper leg 166 with a spacer wall 168 therebetween. A ball type joint 170 is connected at the rear end of the lower leg 164 for engagement with the hook 86 of the trigger 16. The lower leg 164 extends downward and engages the sawteeth 108, atop the legs 94, 96 of the plunger 18. The upper leg 166 is spaced above the lower leg 164 and is cantilevered away from the hook 86 of the trigger 16. The upper leg 166 extends over and is in slideable contact with a lifter 172. The lifter 172 is positioned inside the body portion 20 of the housing 12 and is able to tilt up and down based on the direction of a force applied at one end thereof. On top of the upper leg 166, and exerting a downward pressure on the upper leg 166 towards the lifter 172, is a leaf spring 174. The leaf spring 174 applies a dragging pressure to the lower leg 164, through its contact with the upper leg 166, for dragging the plunger 18 backward. The leaf spring 174 has three recesses 182, 178, 180 extending through and spaced along a back portion thereof for coupling with the hood 14 through bosses melted to mushroom heads 222, 224, 226.

The lifter plate 172 is in the form of a rectangular plate having extending arms 182, 184 on either side projecting towards the cover 195. One of the extending arms 182 has a tab 188 at its distal end. Below the lifter 172 at the side on which the tab 188 is positioned is a compression spring 190 which biases the lifter 172 in an upwardly tilted position.

Placed over a rear part of the body portion 28 and adjacent the cover 195 is a hood 14. The hood 14 is rounded on its top side 192. There is a peripheral ledge 194 on the underside of the hood 14. At both the back end 206 and front end 208, and extending below the ledge 194, are pairs of feet 210, 212, and 214, 216. Each pair of feet are spaced apart a distance equal to the distance between the legs 94, 96 of the plunger 18. The bottom of the feet are arcuately shaped to conform with the top side of the plunger legs 94, 96. Between each pair of feet 210, 212 and 214, 216 and extending a distance less than the length of the legs are locking tabs 218, 220. Also extending downwardly from the ledge 194 of the hood 14, at a point even with the recesses 182, 178, 188 in the leaf spring 174 are the bosses 222, 224, 226. When placed in position, each of the pairs of feet 210, 212 and 214, 216 meet with the top side of the respective plunger legs 94, 96, the locking tabs 218, 220 engage with mating portions 228, 230 within the housing. The mating portion 228 is located on an upper part of the divider 52 facing into the interior of the dispenser and mating portion 230 extends from the body portion 20 of the housing 12 between the extending arms 182, 184 on the lifter 172. The bosses 222, 224, 226 engage the recesses 182, 178, 180 in the leaf spring 174.

The operation of this embodiment differs slightly to that of the earlier described embodiment. This difference is with respect to operation of the lifter 172 regarding initialization of the plunger 18 and engagement of the ratchet 100 between the saw teeth 108.

When the cover 198 of this embodiment is open the ratchet 110 is prevented from operation by the trigger 16. This safety feature is controlled by the combination of the tab 186 on the lifter 92 and the compression spring 190. The tab 186 extends out from under the hood 14 into the path of the cover 198. When the cover 195 is closed it exerts a force on the tab 186, pushing it and the entire lifter 172 down into a normal operating position. When the cover 195 is opened, the compression spring 190 biases the tab 188 into an upward position thus raising the lifter 172. The upward force of the compression spring 190 is a magnitude greater than that exerted downward by the leaf spring 174 on the ratchet 110. This upward force is thus able to overcome the downward force of the leaf spring 174 causing the upper ratchet leg 166 to lift upward. This lifts the lower leg 164 form its position between the saw teeth 108. The lifting of the lower leg 108 prevents the forward motion of the ratchet 110 and thus releases plunger 18 and prevents operation of the trigger 16 from engagement with the plunger 18. It also permits a free pull back of the plunger 18 to initialize the dispenser for receiving a new cartridge 148.

It is to be understood that this dispenser is not limited to use with a cartridge containing only two separate chambers but can be adapted for use with cartridges containing two or more separate chambers. The discussion and drawings illustrating use with a cartridge having two chambers was for purposes of example only and not to limit the application of the invention.

There has been disclosed heretofore the best embodiment of the invention presently contemplated. However, it is to be understood that various changes and modifications may be made thereto without departing from the spirit and scope of the invention.

I claim:

1. A dispenser for dispensing fluid materials from a cartridge having at least two chambers, comprising:

a housing for holding the cartridge;

a trigger having a handle portion extending from the housing, the trigger being pivotably connected with the housing;

a plunger, having a toothed portion on an upper side of the plunger with relation to the handle, the toothed portion facing away from the handle and extending through the housing and including means for advancing into said chambers of the cartridge;

a ratchet connected to the trigger for engagement between adjacent teeth on the toothed portion;

means for applying a frictional drag on said plunger with respect to the housing;

means for applying a forward force to the trigger thereby causing the ratchet to move the plunger forward;

means for applying a return force to the trigger thereby causing the ratchet to move the plunger backward and wherein said forward force is of a larger magnitude than the frictional drag, and the frictional drag is of a magnitude which is able to restrain the application of the return force by the ratchet onto the plunger; and means for delaying application of the frictional drag, whereby the plunger moves only a portion of said backward movement and the ratchet moves the entire backward movement sliding over a tooth of the toothed portion on the plunger located in the line of rearward motion of the ratchet upon application of the frictional drag.

2. The dispenser of claim 1, wherein the plunger has at least two legs.

3. The dispenser of claim 2, wherein the means for applying a frictional drag includes at least two grooves for passage therethrough of said plunger legs, each groove comprising a pair of facing side walls, each side wall containing a slot extending therealong and a brake wire positioned about each groove within the facing side walls for frictional engagement with the respective leg of the plunger passing therethrough, wherein each of the at least two brakes are of a diameter less than the width of the slots whereby the brakes can freely move within the slots.

4. The dispenser of claim 1, wherein the means for applying a return force comprises a return spring connected to the trigger.

5. The dispenser of claim 4, further comprising a leaf spring for exerting a downward force on the ratchet for maintaining engagement of the ratchet between the plunger teeth.

6. The dispenser of claim 1, further comprising a lifter for disengaging the ratchet from between the teeth.

7. The dispenser of claim 6, wherein the lifter includes tabs extending on an out side of the housing for manually disengaging the ratchet from between the teeth.

8. The dispenser of claim 7, wherein the lifter extends across the housing along an under side of the plunger and includes a ledge on either side of the plunger for engagement with the ratchet. --

9. The dispenser of claim 1, further comprising a cover rotatably mounted to the housing for locking the cartridge in place.

10. The dispenser of claim 9, further comprising means for disengaging the ratchet from its engagement between the plunger teeth when the cover is in an open position.

11. The dispenser of claim 10, further comprising a compression spring located beneath the means for disengaging, said compression spring exerting a lifting force on the means for disengaging, the lifting force being of a smaller magnitude than a closing force exerted on the means for disengaging by the cover when in a closed position.

12. The dispenser of claim 11, wherein the cover includes locking tabs for engagement with the cartridge to hold the cartridge in place within the housing.

13. The dispenser of claim 11, wherein the cover further includes a handle, having a notch and the housing further includes a recess for engagement with the notch for locking the cover in a closed position.

14. The dispenser of claim 1, wherein the housing includes first and second recesses on an inner side thereof, and the trigger includes first and second pins extending outward from a top side thereof for engagement with a respective one of the first and second recesses allowing for the pivotable connection between the trigger and housing.

15. The dispenser of claim 1, wherein no space exists between a base of each adjacent tooth on each of the at least two legs.

16. The dispenser of claim 1, further comprising a hood removably attached to the housing at a position between the cartridge and a rear end of the housing.

17. The dispenser of claim 1, wherein the means for applying a frictional drag includes at least one groove for passage therethrough of said plunger, the at least one groove comprising a pair of facing side walls, each side wall containing a slot extending therealong and a brake wire positioned about the at least one groove within the facing side walls for frictional engagement with the plunger passing therethrough, wherein each of the at least one brake is of a diameter less than the width of the slots whereby the brake can freely move within the slots.

18. The dispenser of claim 17, wherein, each slot comprises first and second end walls on either side thereof, extending outward from the facing side walls, for restricting the movement of each of the brakes to the area between the respective first and second end walls.

19. A dispenser for dispensing fluid materials from a cartridge, comprising:

a housing for retaining the cartridge, said housing comprising a body portion and a cover, means for rotatably coupling said cover to the body portion for facilitating insertion and removal of the cartridge;

a trigger pivotably connected to the housing;

a plunger having a toothed portion and extending through the housing and including means for extending into said chambers of the cartridge;

a lifter mounted in the housing having at least one arm extending into the path of the cover when the cover is in a closed position;

a ratchet connected to the trigger for engagement with the toothed surface; and a spring connected between the housing and the lifter for biasing the lifter to disengage the ratchet from the plunger teeth, when the cover is in an open position.

20. The dispenser of claim 19, wherein the plunger has at least two legs.

21. The dispenser of claim 19, wherein the plunger teeth are on an upper side, thereof.

22. The dispenser of claim 19, wherein the ratchet includes a lower leg for engaging between adjacent plunger teeth and an upper leg spaced above the lower leg and cantilevered away from the trigger, the upper leg extending over and in slideable contact with the lifter for limiting movement of the ratchet in the forward direction to a distance equal to the length of the upper leg.

23. A dispenser for dispensing fluid materials from a cartridge having at least two chambers, comprising:

a housing for holding the cartridge;

a trigger pivotably connected with the housing;

a plunger, having a toothed portion and extending through the housing and including means for extending into said chambers of the cartridge;

a ratchet connected to the trigger for engagement between adjacent teeth on the toothed portion;

means for applying a frictional drag on said plunger with respect to the housing;

means for applying a forward force to the trigger thereby causing the ratchet to move the plunger forward;

means for applying a return force to the trigger thereby causing the ratchet to move the plunger backward and wherein said forward force is of a larger magnitude than the frictional drag, and the frictional drag is of a magnitude which is able to restrain the application of the return force by the ratchet onto the plunger; and means for delaying application of the frictional drag, whereby the plunger moves only a portion of said backward movement and the ratchet moves the entire backward movement sliding over a tooth on the plunger located in the line of rearward motion of the ratchet upon application of the frictional drag.

* * * * *